US008333039B2

(12) United States Patent
Hsu et al.

(10) Patent No.: US 8,333,039 B2
(45) Date of Patent: Dec. 18, 2012

(54) MOVABLE BUILDING

(75) Inventors: Mu-Chi Hsu, Taipei Hsien (TW); Dong-Sheng Lin, Taipei Hsien (TW); Chin-Tsan Huang, Taipei Hsien (TW); Guo-Jiang Wu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 210 days.

(21) Appl. No.: 12/612,086

(22) Filed: Nov. 4, 2009

(65) Prior Publication Data

US 2011/0036018 A1 Feb. 17, 2011

(30) Foreign Application Priority Data

Aug. 12, 2009 (CN) ..... 2009 1 0305538

(51) Int. Cl.
*E04H 1/00* (2006.01)

(52) U.S. Cl. ..... 52/79.9; 52/79.5; 52/236.3; 52/79.12; 52/236.4

(58) Field of Classification Search ..... 52/79.1, 52/79.5, 79.9, 234, 236.3, 236.4, 79.12
See application file for complete search history.

(56) References Cited

U.S. PATENT DOCUMENTS

| | | | | | |
|---|---|---|---|---|---|
| 3,393,479 | A * | 7/1968 | Slotnick | 52/2.17 |
| 3,497,606 | A * | 2/1970 | Andrews et al. | 174/379 |
| 3,540,173 | A * | 11/1970 | Johnides | 52/79.5 |
| 3,678,639 | A * | 7/1972 | Panitz | 52/79.1 |
| 3,680,273 | A * | 8/1972 | Bigelow, Jr. | 52/143 |
| 3,855,743 | A * | 12/1974 | Wokas | 52/79.1 |
| 3,925,679 | A * | 12/1975 | Berman et al. | 290/1 R |
| 4,327,529 | A * | 5/1982 | Bigelow et al. | 52/34 |
| 4,501,098 | A * | 2/1985 | Gregory | 52/79.1 |
| 4,599,829 | A * | 7/1986 | DiMartino, Sr. | 52/79.7 |
| 4,637,179 | A * | 1/1987 | Bigelow et al. | 52/79.5 |
| 4,644,708 | A * | 2/1987 | Baudot et al. | 52/79.9 |
| 4,854,094 | A * | 8/1989 | Clark | 52/79.1 |
| 5,353,557 | A * | 10/1994 | Lerner et al. | 52/106 |
| 5,353,558 | A * | 10/1994 | Shea et al. | 52/143 |
| 5,735,639 | A * | 4/1998 | Payne et al. | 405/129.57 |
| 5,826,386 | A * | 10/1998 | Casteel | 52/236.3 |
| 5,864,992 | A * | 2/1999 | Bigelow | 52/90.1 |
| 6,330,771 | B1 * | 12/2001 | Hester, Jr. | 52/234 |
| 6,332,298 | B1 * | 12/2001 | Bigelow | 52/648.1 |
| 6,983,567 | B2 * | 1/2006 | Ciotti | 52/79.5 |
| 2007/0044833 | A1 * | 3/2007 | Chern et al. | 136/259 |
| 2007/0094946 | A1 * | 5/2007 | Schoeny et al. | 52/79.1 |
| 2007/0163184 | A1 * | 7/2007 | Olesch | 52/79.5 |
| 2007/0271857 | A1 * | 11/2007 | Heather et al. | 52/79.9 |
| 2008/0236056 | A1 * | 10/2008 | Hourihan | 52/79.9 |
| 2011/0016801 | A1 * | 1/2011 | Ziegelman | 52/79.9 |
| 2011/0056147 | A1 * | 3/2011 | Beaudet | 52/79.9 |

FOREIGN PATENT DOCUMENTS

| | | | |
|---|---|---|---|
| CN | 101191384 | A | 6/2008 |
| EP | 366559 | A1 * | 5/1990 |
| FR | 2211034 | A * | 8/1974 |

* cited by examiner

*Primary Examiner* — Robert Canfield
*Assistant Examiner* — Babajide Demuren
(74) *Attorney, Agent, or Firm* — Altis Law Group, Inc.

(57) ABSTRACT

A building includes a wall and a roof. The wall encloses an enclosed area, and the wall comprises a plurality of standardized modules, each having an inner space used as a room. The roof covers the enclosed area. The standardized modules are standardized, and thus very convenient to manufacture. In addition, the standardized modules can be transported quickly and efficiently, therefore, the building as disclosed is convenient and reliable to construct and dismantle.

17 Claims, 8 Drawing Sheets

MOVABLE BUILDING

BACKGROUND

1. Technical Field

The present disclosure generally relates to building structures, and particularly, to a movable building.

2. Description of Related Art

Demolition of abandoned or unwanted building structures requires considerable resource and manpower expenditure. Most materials remaining after demolition are difficult or impossible to reuse or recycle, representing serious waste.

Industrial, event-related, and other temporary structures are often required on short notice. Additionally, structures required for disaster relief and other emergencies are urgently needed. Few conventional construction technologies can fulfill such demands.

Therefore, a solution is desired to overcome the described limitations.

BRIEF DESCRIPTION OF THE DRAWINGS

The components in the drawings are not necessarily drawn to scale, the emphasis instead being provided upon clearly illustrating the principles of the present disclosure. Moreover, in the drawings, like reference numerals designate corresponding parts throughout several views, and all the views are schematic.

DETAILED DESCRIPTION

Figure 1:
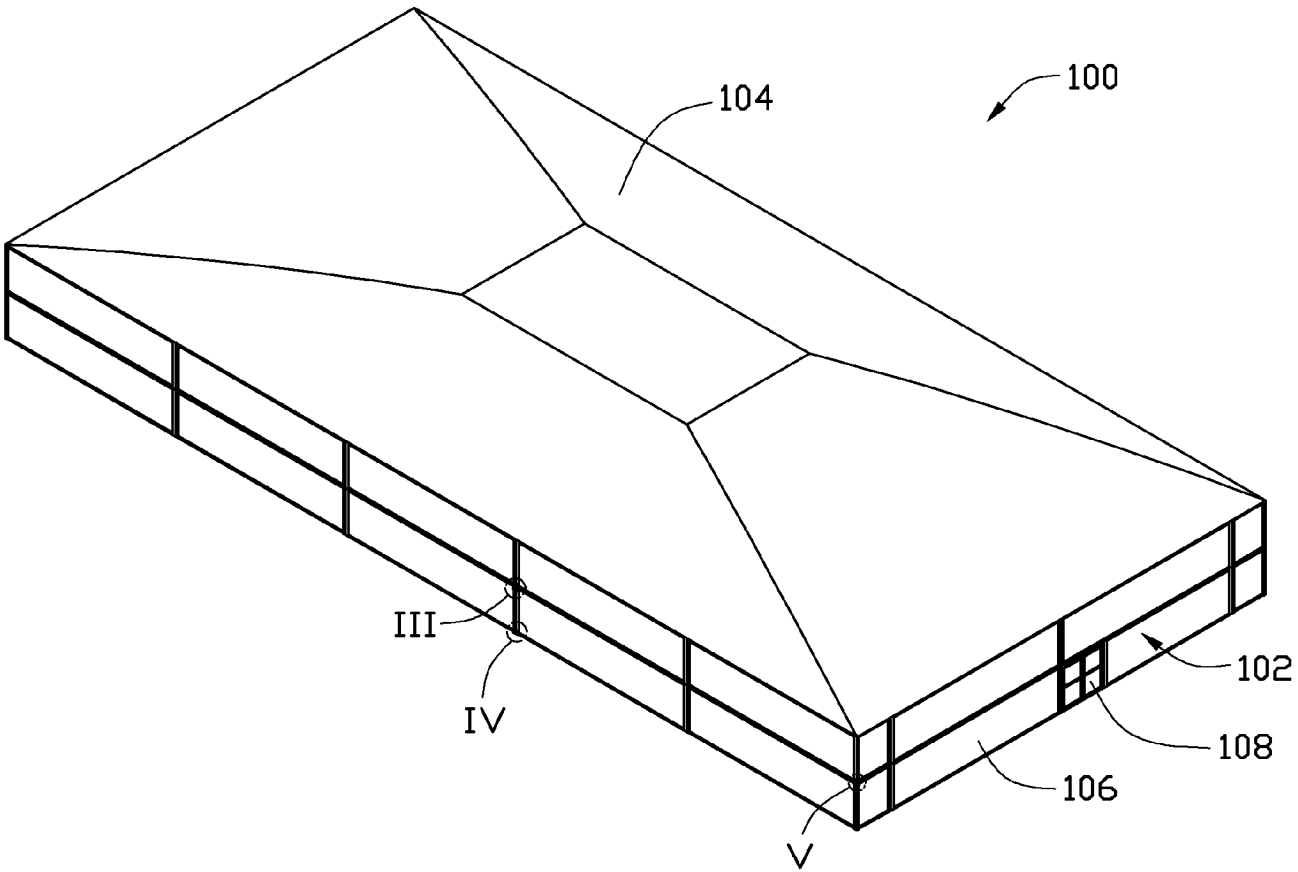
FIG. 1 is a schematic, isometric view of an embodiment of a building as disclosed, the building including a wall having a plurality of modules and a roof.
Figure 2:
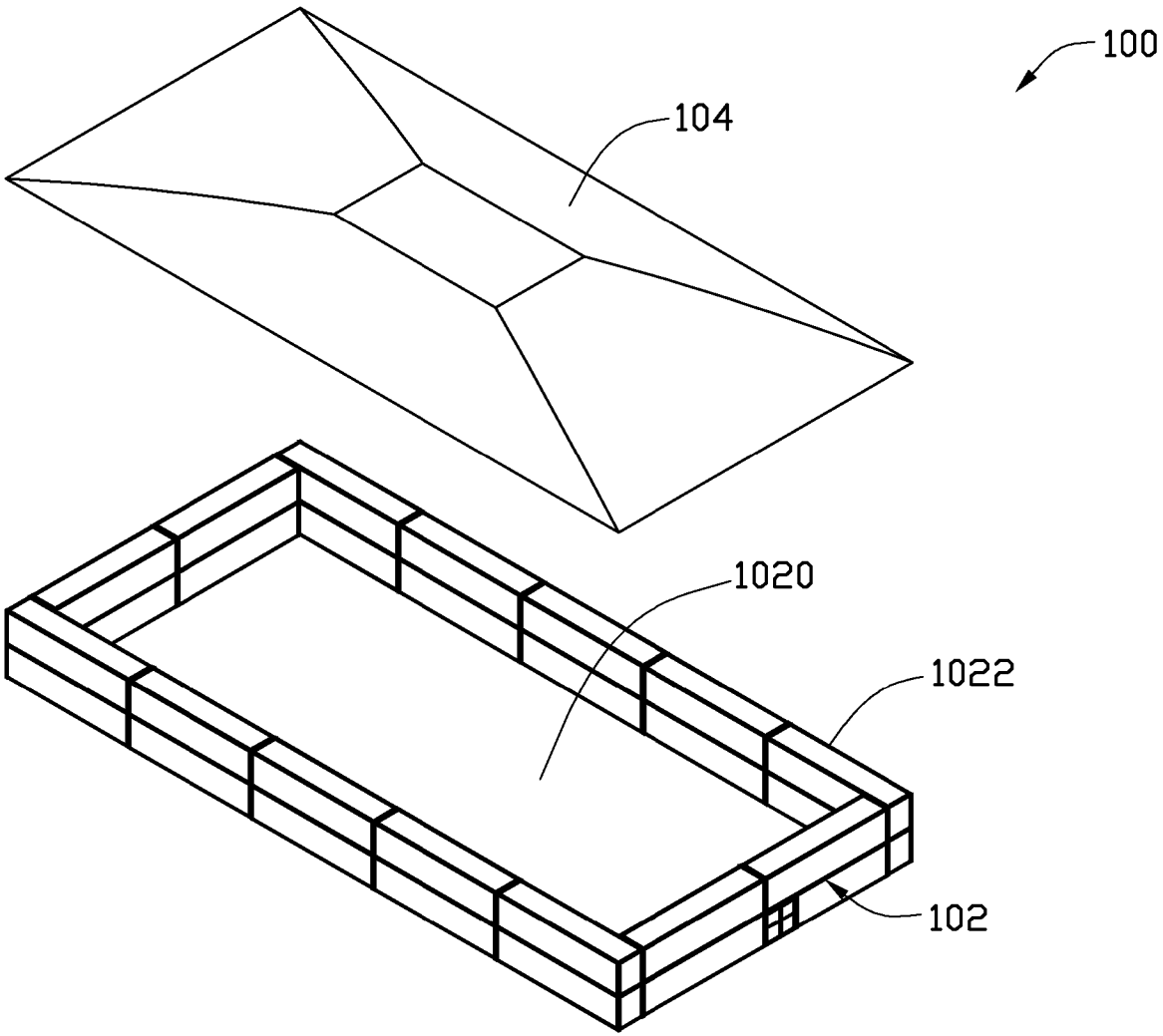
FIG. 2 is a schematic, isometric view of the wall of FIG. 1.

Referring to FIG. 1, a first embodiment of a building 100 includes a wall 102 and a roof 104. The wall 102 is fixed to the ground, and the roof 104 is fixed to a top of the wall 102.

The wall 102 includes a plurality of modules 106. In the illustrated embodiment, the module 106 is substantially a hollowed cuboid, and the wall 102 includes twenty eight modules 106, arranged into two stories, each row of each story including four modules 106 and each column of each story including five modules 106. Alternatively, the wall 102 may include any number of modules 106 in any arrangement, as long as the modules 106 can form a wall 102. The modules 106 in each story are connected end-to-end. While in the illustrated embodiment, all of the modules 106 are the same size and shape, that is, the modules 106 are standardized modules. Alternatively, the size and shape of the modules 106 may be different. The cube-shaped modules 106 of the same size allow convenient construction. The wall 102 may extend to form a rectangular or circular enclosure.

The plurality of modules 106 cooperatively form an enclosed area 1020. The wall 102 includes a top edge 1024 facing an outside of the wall 102 at a top thereof. The roof 104 is connected to the top edge 1024 of the wall 102, covering the enclosed area 1020. A ladder 1026 may be arranged in the enclosed area 1020 or outside the building 100 as desired. In the illustrated embodiment, the roof 104 is an air supported structure, especially as provided by Air Structures American Technologies, Inc. This kind of air supported structure allows long span structure and provides stability and safety. The air supported structure, usable in permanent buildings, is well suited to long span structures.

The module 106 includes a sidewall (not labeled) enclosing an inner space. That is, the module 106 is an object having an inner space. The inner space of the module 106 may be used as a room, such as an office, a storehouse, or an equipment room.

Each module 106 is an independent, integrated member. When moved, the module 106 moves as a whole. In the illustrated embodiment, each module 106 is a cargo container, allowing convenience of transport. To facilitate manufacture of the modules 106 or change a structure of the wall 102 by addition, removal, or replacement of modules 106, the modules 106 have varying available, standardized dimensions. Modules 106 with various standardized size and/or shape are available, allowing choice of suitable size and shape.

One or more doors 108 or windows (not shown) may be installed in one or more modules 106, as desired. The door 108 or window may be defined during manufacture of the module 106, or later, onsite.

Connecting sheets (not shown) are formed on a bottom of each module 106 on the first story, and other connecting sheets (not shown) are fixed on the ground. The connecting sheets on the module 106 and the connecting sheets on the ground are fixed together, for example by fasteners such as screws, thus fixing the building 100 in place. The connecting sheets may be fixed to the module 106 by welding, and the other connecting sheets may be fixed on the ground by setting in concrete.

Figure 3:
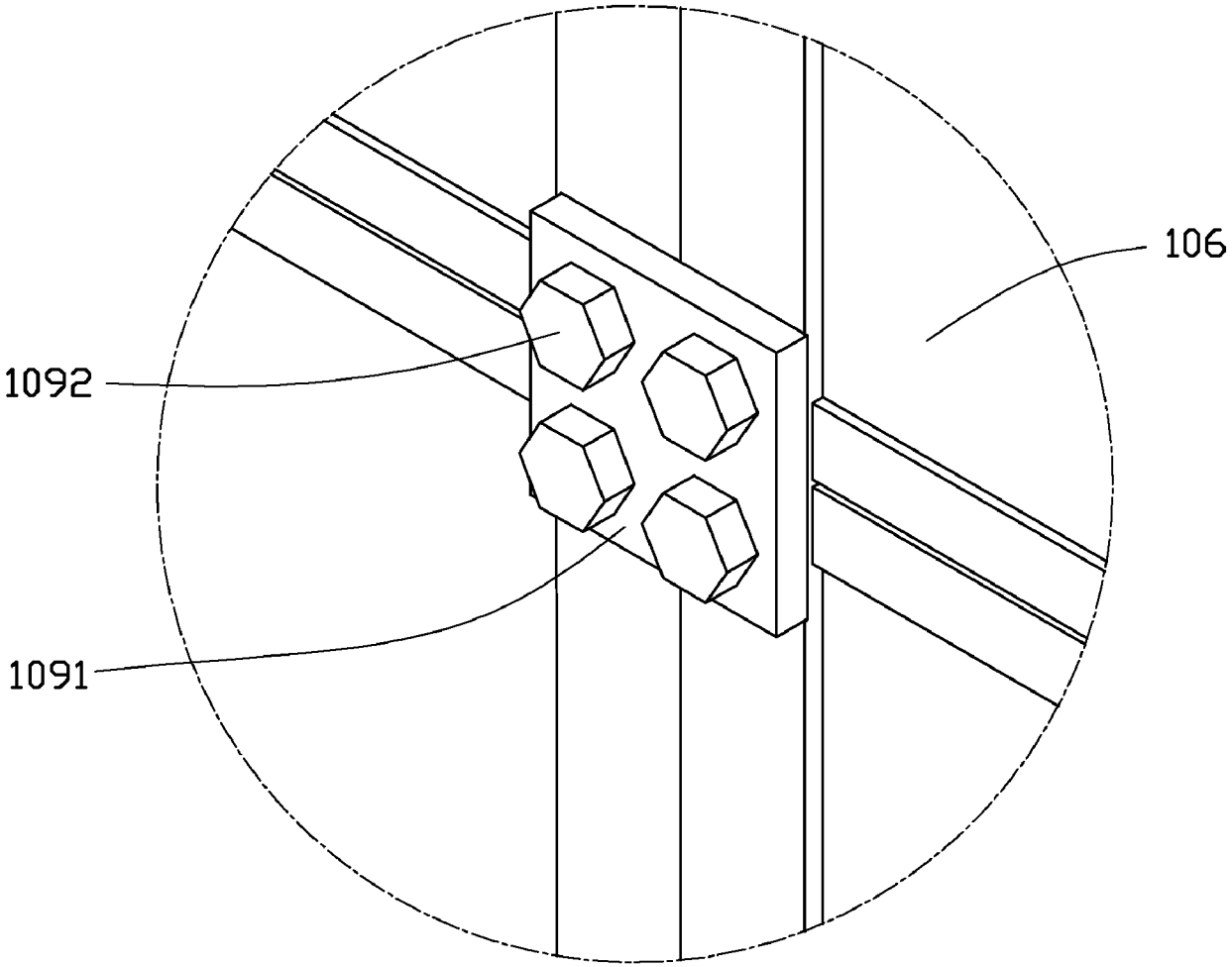
FIG. 3 is an enlarged view of region III in FIG. 1.
Figure 4:
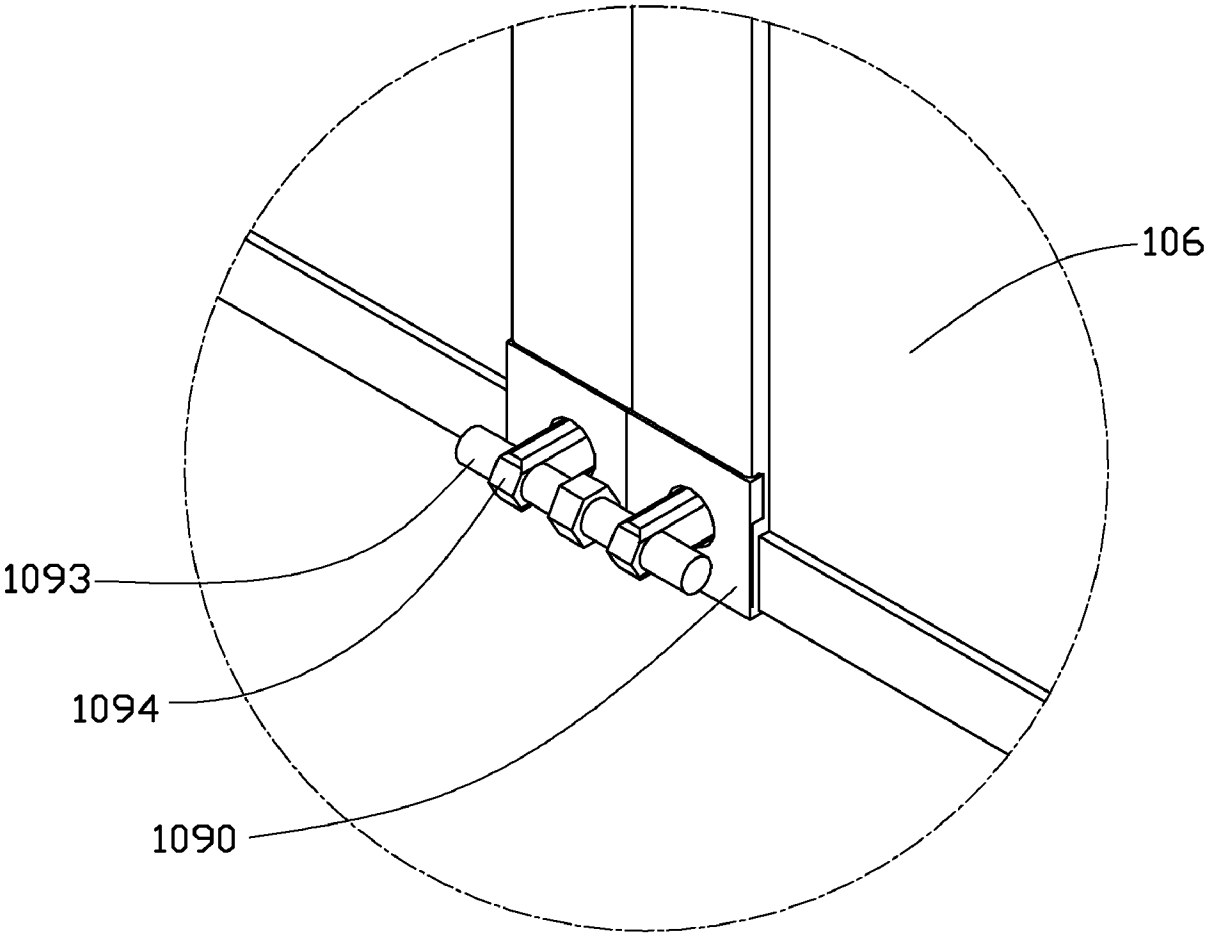
FIG. 4 is an enlarged view of region IV in FIG. 1.

Referring to FIG. 3, when connecting four adjacent modules 106, a fixing plate 1091 and a plurality of fasteners 1092 may be provided. The fixing plate 1091 is attached to the four modules 106, and each of the four modules 106 is fixed to the fixing plate 1091 by at least one fastener 1092. This fixing manner may also be used to fix two, three or other number adjacent modules 106. Referring to FIG. 4, when connecting two adjacent modules 106, a connecting piece 1090, a catching member 1093, and two posts 1094 may be provided. The posts 1094 run through the connecting piece 1090 with a larger end (not shown) of each post 1094 at one side of the connecting piece 1090. The connecting piece 1090 is fixedly latched on the two modules 106, thus fixing the posts 1094 to the modules 106 respectively. Two opposite ends of the catching member 1093 define threads with contrary helical directions, and the opposite ends of the catching member 1093 are fastened with the posts 1094 respectively, thus, the adjacent modules 106 move closer when rotating the catching member 1093.

Figure 5:
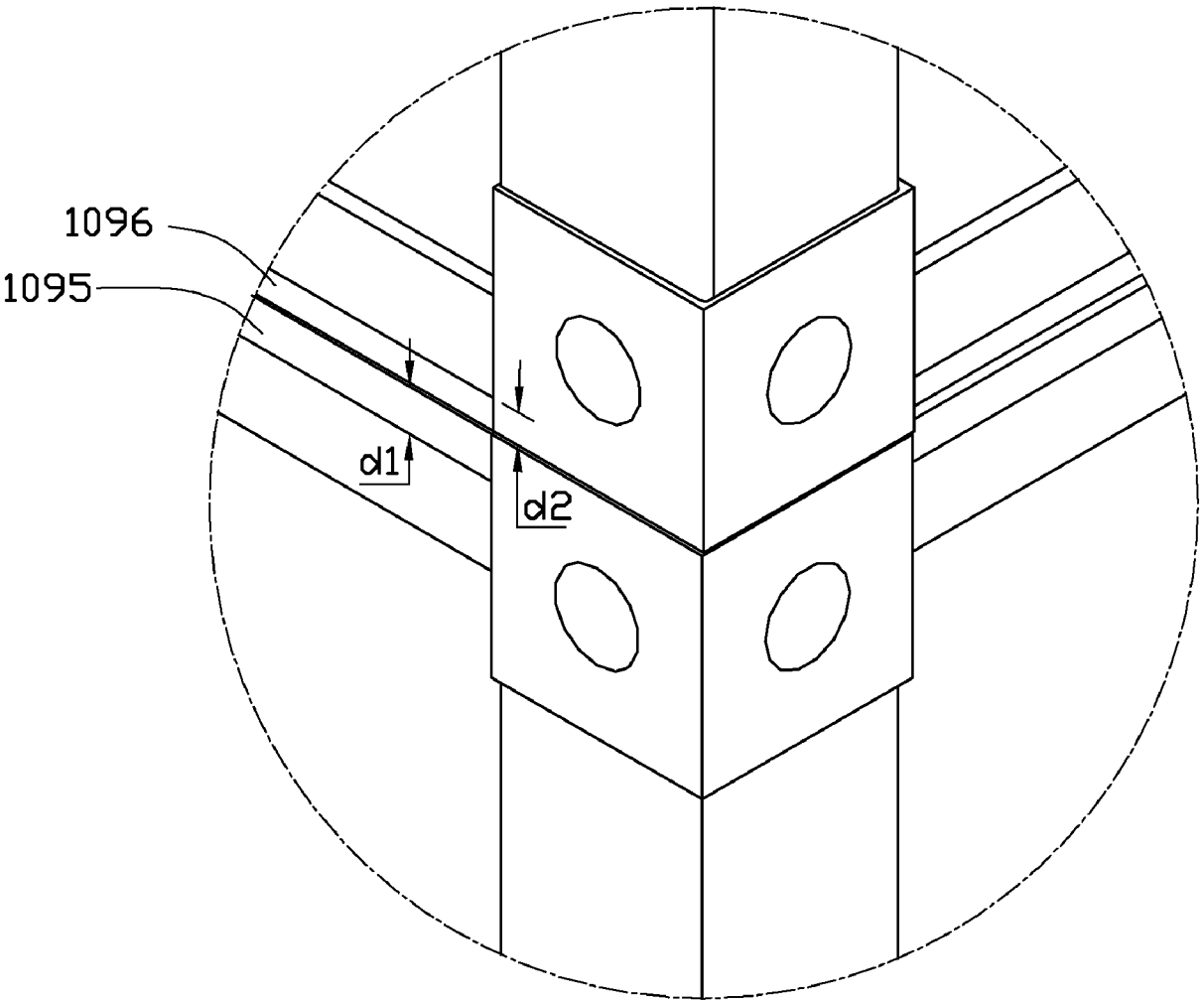
FIG. 5 is an enlarged view of region V in FIG. 1.
Figure 6:
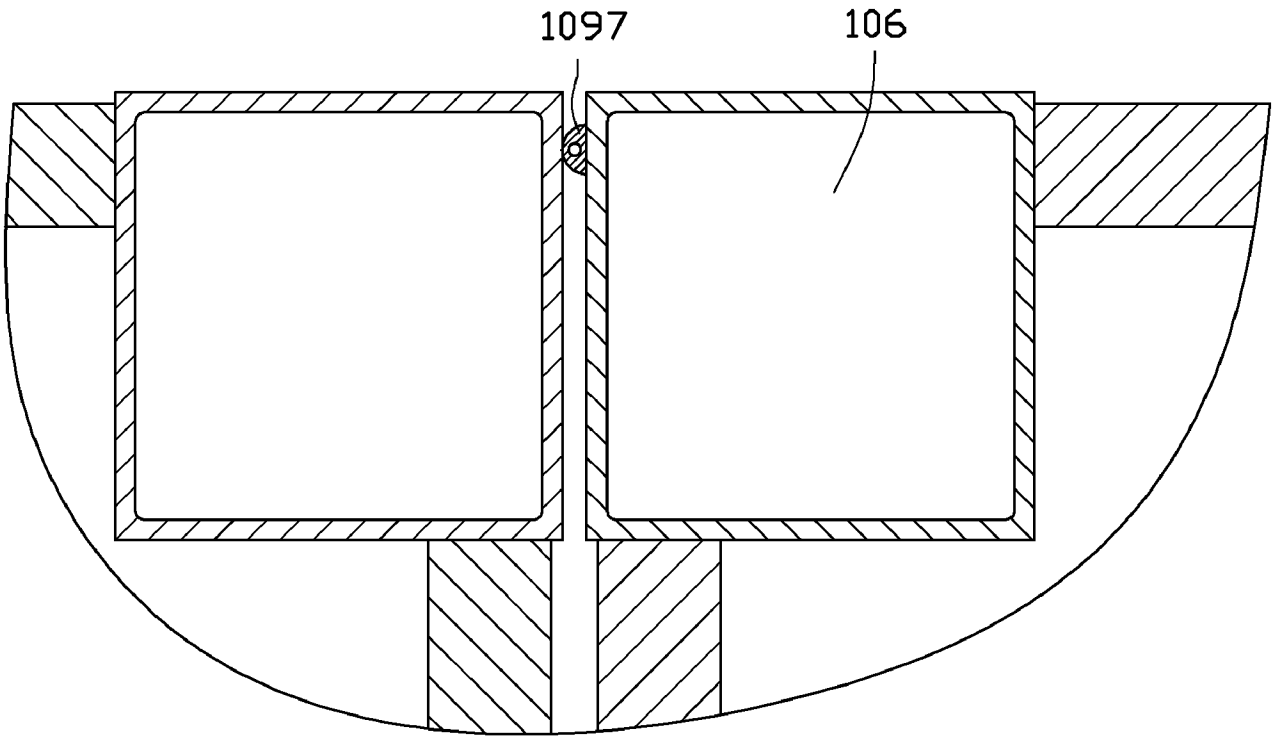
FIG. 6 is a partial, enlarged, cross-section of FIG. 1.
Figure 7:
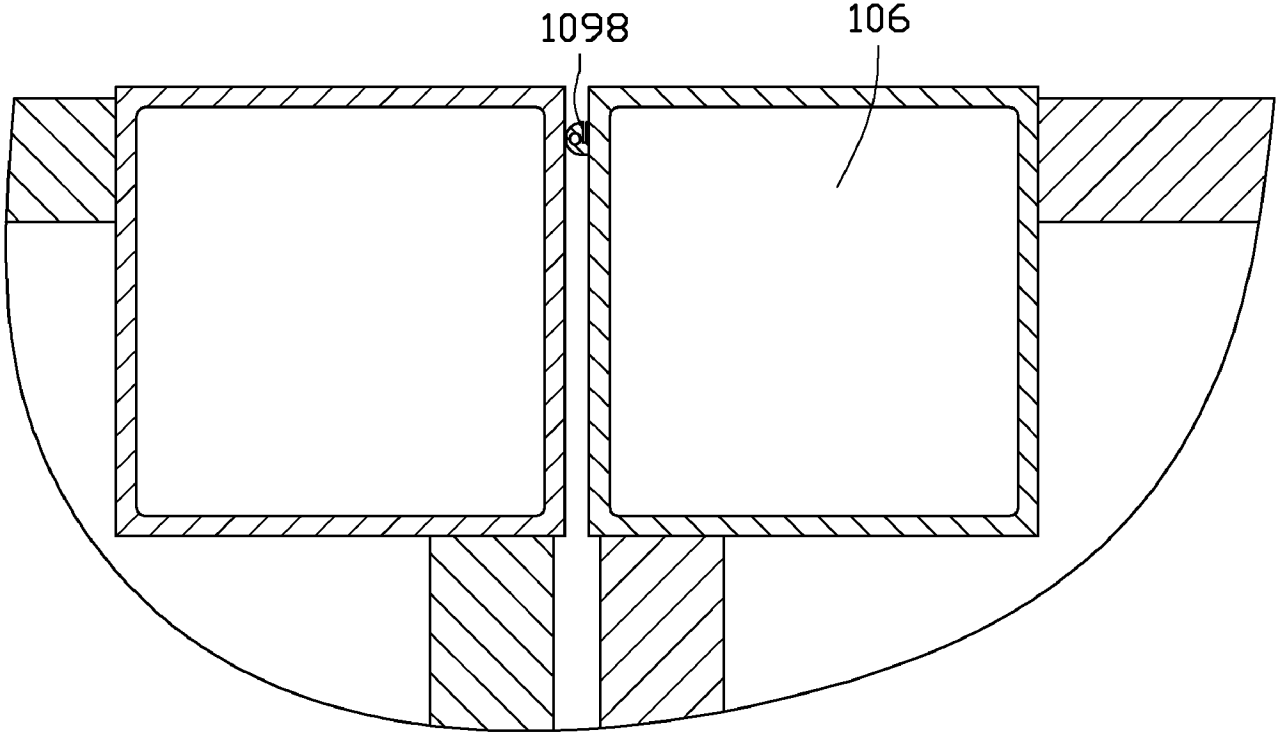
FIG. 7 is another partial, enlarged, cross-section of FIG. 1.
Figure 8:
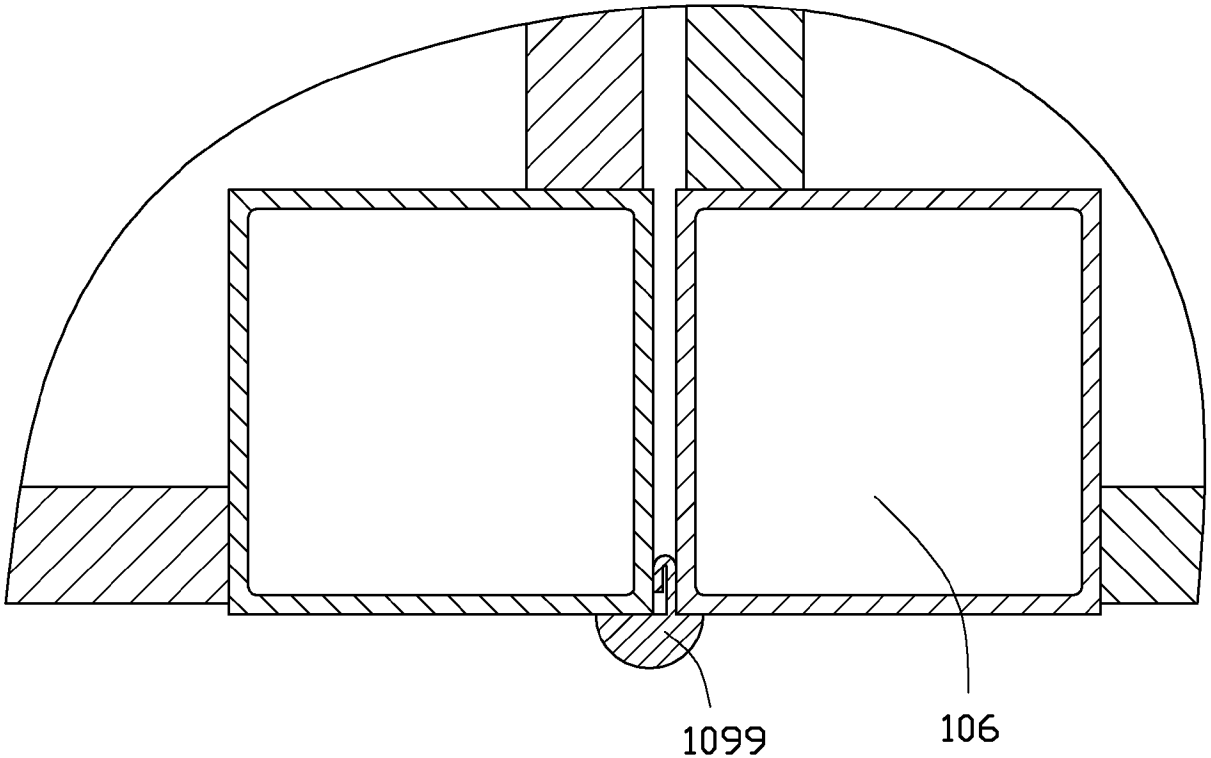
FIG. 8 is a further partial, enlarged, cross-section of FIG. 1.

Referring to FIG. 5, when sealing adjacent modules 106 at different stories, a first sealing member 1095 and a second sealing member 1096 may be provided. Usually, a top corner of the module 106 is higher than other portions of d1, and a bottom corner of the module 106 is larger than other portions of d2. The first sealing member 1095 with height of d1 is mounted on one module 106, and the second sealing member 1096 with height of d2 is mounted on the other module 106, thus a gap between the two modules 106 is sealed. Generally, the second sealing member 1096 is made of elastic materials, such as rubber. The second sealing member 1096 may be slightly higher than d2. Referring to FIG. 6, a third sealing member 1097 may be provided to seal two adjacent modules 106 at a same story. The third sealing member 1097 is elastic and defines a hole to easier deform the third sealing member 1097. Referring to FIG. 7, a fourth sealing member 1098 may be provided to seal two adjacent modules 106 at a same story. The fourth sealing member 1098 is elastic and defines a hole and a cutout. Referring to FIG. 8, a fifth sealing member 1099 may be provided to seal two adjacent modules 106 at a same story. The fifth sealing member 1099 includes an elastic curved portion. The curved portion deforms to seal a gap between the modules 106. Pressure between the modules 106 may be increased to increase resistance from the curved portion, thus improving the seal. When positioning the third, fourth, fifth sealing members 1097, 1098, 1099, the sealing members 1097, 1098, 1099 are fixed to one module 106 and resist the other module 106. With arrangement of the sealing members 1097, 1098, 1099, the enclosed area 1020 is isolated from the exterior of the building 100, having filled all gaps between modules 106.

The building 100 as disclosed is convenient, reliable, and safe to construct and dismantle. The modules 106 and the roof 104 can be transported quickly and efficiently. The modules 106 are standardized, and thus very convenient to manufacture.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A building, comprising:

a wall enclosing an enclosed area, wherein the wall comprises a plurality of standardized modules, the plurality of standardized modules are substantially hollowed cuboids and stacked in at least two stories, the wall is rectangular and encloses the enclosed area, and the wall has a rectangular outer surface and a rectangular inner surface, serialized modules of a story of the at least two stories are connected end-to-end, and each of the plurality of standardized modules comprising an inner space used as a room; and a roof covering the enclosed area;

wherein the building further comprises a connecting piece, a catching member, and two posts, the posts pass through the connecting piece with a larger end of each post at one side of the connecting piece, and the connecting piece comprises two parts abutting against each other and respectively fixedly latched on the two standardized modules, to fix the posts to the standardized modules respectively, two opposite ends of the catching member define threads with contrary helical directions, the catching member extends through the posts, and the opposite ends of the catching member are fastened with the posts respectively, such that the catching member is substantially parallel to the connecting piece, and the adjacent standardized modules move closer upon rotation of the catching member.

2. The building of claim 1, wherein the wall is fixed to the ground.

3. The building of claim 1, wherein the roof comprises an air supported structure.

4. The building of claim 1, wherein each of the standardized modules is an independent, integrated member.

5. The building of claim 4, wherein each of the standardized modules is a cargo container.

6. The building of claim 1, wherein the wall and the roof are detachably connected, and the standardized modules of the wall are detachably connected.

7. The building of claim 1, wherein the building further comprises a fixing plate and a plurality of fasteners, the fixing plate attached to adjacent standardized modules, and each of the standardized modules are fixed to the fixing plate by at least one fastener, to connect the adjacent standardized modules.

8. The building of claim 1, wherein a sealing member is positioned between standardized modules, isolating the enclosed area from the exterior of the building by eliminating gaps between the standardized modules, the sealing member comprises a hole or a cutout therein.

9. A building, comprising:

a wall comprising a plurality of modules which are substantially hollowed cuboids and stacked in at least two stories, the plurality of modules of a story of the at least two stories are connected end-to-end, the wall is rectangular and encloses an enclosed area, and the wall has a rectangular outer surface and a rectangular inner surface each of the plurality of modules being an independent, integrated member and including an inner space; and a roof disposed on the wall;

wherein the building further comprises a connecting piece, a catching member, and two posts, the posts pass through the connecting piece with a larger end of each post at one side of the connecting piece, and the connecting piece comprises two parts abutting against each other and respectively fixedly latched on the two standardized modules, to fix the posts to the standardized modules respectively, two opposite ends of the catching member define threads with contrary helical directions, the catching member extends through the posts, and the opposite ends of the catching member are fastened with the posts respectively, such that the catching member is substantially parallel to the connecting piece, and the adjacent standardized modules move closer upon rotation of the catching member.

10. The building of claim 9, wherein the wall is fixed to the ground.

11. The building of claim 9, wherein the roof comprises an air supported structure.

12. The building of claim 9, wherein the modules have a standardized size and shape.

13. The building of claim 9, wherein the wall and the roof are detachably connected, and the modules of the wall are detachably connected.

14. The building of claim 9, wherein the building further comprises a fixing plate and a plurality of fasteners, the fixing plate attached to adjacent modules, and each of the modules are fixed to the fixing plate by at least one fastener, to connect the adjacent modules.

15. The building of claim 9, wherein a sealing member is positioned between modules, isolating the enclosed area from the exterior of the building by eliminating gaps between the modules, the sealing member comprises a hole or a cutout therein.

16. The building of claim 3, wherein the roof comprises a substantially hollowed cuboids top surface, a substantially hollowed cuboids bottom surface, and four side surfaces connecting the top surface to the bottom surface, the four side surfaces connect with each other.

17. The building of claim 11, wherein the roof comprises a substantially hollowed cuboids top surface, a substantially hollowed cuboids bottom surface, and four side surfaces connecting the top surface to the bottom surface, the four side surfaces connect with each other.

* * * * *